US011352820B2

(12) United States Patent
Tylla

(10) Patent No.: US 11,352,820 B2
(45) Date of Patent: Jun. 7, 2022

(54) VEHICLE DOOR

(71) Applicant: Dr. Ing. h.c. F. Porsche Aktiengesellschaft, Stuttgart (DE)

(72) Inventor: Pascal Tylla, Leonberg (DE)

(73) Assignee: Dr. ing. h. c. F. Porsche AG, Stuttgart (DE)

( * ) Notice: Subject to any disclaimer, the term of this patent is extended or adjusted under 35 U.S.C. 154(b) by 176 days.

(21) Appl. No.: 16/845,147

(22) Filed: Apr. 10, 2020

(65) Prior Publication Data

US 2020/0325708 A1 Oct. 15, 2020

(30) Foreign Application Priority Data

Apr. 10, 2019 (DE) ..... 10 2019 109 395.3

(51) Int. Cl.
*E05B 85/10* (2014.01)
*E05B 79/06* (2014.01)

(52) U.S. Cl.
CPC ..... *E05B 85/103* (2013.01); *E05B 85/10* (2013.01); *E05Y 2900/531* (2013.01); *Y10S 292/31* (2013.01); *Y10T 292/57* (2015.04)

(58) Field of Classification Search
CPC ..... E05B 85/10; E05B 85/103; Y10S 292/31; Y10T 292/57
See application file for complete search history.

(56) References Cited

U.S. PATENT DOCUMENTS

| | | | | |
|---|---|---|---|---|
| 2,117,192 | A * | 5/1938 | McClung | E05B 85/10 292/166 |
| 4,459,331 | A * | 7/1984 | Brix | B60R 13/02 156/250 |
| 5,868,455 | A * | 2/1999 | Springer | B29C 66/80 296/146.1 |
| 6,657,537 | B1 * | 12/2003 | Hauler | B60R 25/24 180/287 |
| 7,091,836 | B2 * | 8/2006 | Kachouh | E05B 81/78 340/426.28 |
| 7,173,346 | B2 * | 2/2007 | Aiyama | B60R 21/0136 307/10.1 |
| 7,375,299 | B1 * | 5/2008 | Pudney | E05B 81/78 200/61.62 |
| 9,416,565 | B2 * | 8/2016 | Papanikolaou | E05B 81/14 |
| 10,053,893 | B1 | 8/2018 | Patel et al. | |
| 10,604,971 | B2 | 3/2020 | Pohl et al. | |
| 2002/0005016 | A1 | 1/2002 | Menke | |

(Continued)

FOREIGN PATENT DOCUMENTS

| | | | |
|---|---|---|---|
| CN | 105431605 | 3/2016 | |
| DE | 19755843 A1 * | 6/1999 | E05B 85/10 |

(Continued)

OTHER PUBLICATIONS

Chinese Office Action dated Jan. 29, 2021.
German Search Report dated Nov. 13, 2019.

*Primary Examiner* — Carlos Lugo
(74) *Attorney, Agent, or Firm* — Gerald E. Hespos; Michael J. Porco

(57) ABSTRACT

A vehicle door (2) has a fixed door handle (2) that is flush with the surface of a door outer skin (4). The door handle (2) has a button (15) for actuating a locking device (5) of the vehicle door (1). The door handle (2) has a web (6) that is part of the door outer skin (4).

5 Claims, 1 Drawing Sheet

(56) References Cited

U.S. PATENT DOCUMENTS

| | | | | |
|---|---|---|---|---|
| 2003/0101781 | A1* | 6/2003 | Budzynski | E05B 85/10 70/239 |
| 2015/0069768 | A1* | 3/2015 | Leve | E05B 5/00 292/336.3 |
| 2016/0138307 | A1 | 5/2016 | Pohl et al. | |
| 2016/0230429 | A1* | 8/2016 | Witte | E05B 85/16 |

FOREIGN PATENT DOCUMENTS

| | | | | |
|---|---|---|---|---|
| DE | 102007050094 | A1 * | 4/2009 | E05B 81/78 |
| DE | 10 2008 010 488 | | 8/2009 | |
| DE | 10 2013 212 083 | | 1/2014 | |
| DE | 10 2013 012 489 | | 1/2015 | |
| DE | 10 2015 101 733 | | 8/2016 | |
| DE | 10 2015 209 851 | | 12/2016 | |
| EP | 1 167 666 | | 1/2002 | |
| KR | 20150145371 | A * | 12/2015 | |

* cited by examiner

VEHICLE DOOR

CROSS REFERENCE TO RELATED APPLICATION

This application claims priority under 35 USC 119 to German Patent Appl. No. 10 2019 109 395.3 filed on Apr. 10, 2019, the entire disclosure of which is incorporated herein by reference.

BACKGROUND

Field of the Invention

The invention relates to a vehicle door having a fixed door handle that is flush with the surface of a door outer skin and that has a button for actuating a locking device of the vehicle door.

Related Art

DE 10 2013 212 083 A1 discloses a flush-mounted handle system for a vehicle door that has inner and outer sides. A part of the outer side defines a surface contour. A handle is open toward the side and has a pocket formed in the vehicle. Thus, a user can put his or her fingers into the pocket and pull the door open. A sensor is attached to the door alongside the pocket at a position in that part of the outer side that defines a surface contour. The sensor is selected from the group consisting of proximity sensors and touch sensors.

DE 10 2008 010 488 A1 discloses a motor vehicle bodyshell with a front door having a first door handle recess, and a rear door having a second door handle recess. A first touch-sensitive sensor is provided in the first door handle recess for opening the front door and/or a second touch-sensitive sensor is provided in the second door handle recess for opening the rear door.

DE 10 2015 101 733 A1 discloses a vehicle door handle arrangement having a sensor device for detecting an actuation and having a handle. An actuating element is arranged on a side of the handle that can be engaged behind. The actuating element can be actuated by an operator when the handle is engaged behind. The actuating element protrudes out beyond the outer contour of the handle through an opening in the handle, from an inner cavity of the handle, through a wall of the handle.

It is an object of the invention to improve the function and/or manufacture of a vehicle door having a fixed door handle that is flush with the surface of a door outer skin, and having a button for actuating a locking device of the vehicle door.

SUMMARY

The invention relates to a vehicle door having a fixed door handle that is flush with the surface of a door outer skin and that has a button for actuating a locking device of the vehicle door. The door handle comprises a web that is connected integrally to the door outer skin and thus can be manufactured in a simple and cost-effective manner. In addition, a door handle that comprises a web of the outer skin can have an original design that can be realized in a simple manner.

The web may comprise at least two engagement openings in the door outer skin, and in one embodiment delimits exactly two engagement openings in the door outer skin. The web may define an elongate rectangle, and the engagement openings also may have substantially the same elongate rectangle shapes. The shape of the elongate rectangular openings may be rounded or pointed at the ends.

The engagement openings may be punched out of the door outer skin. The door outer skin may be a metal panel. Punching the apertures in the metal panel that forms the door outer skin can be realized in a simple manner.

The engagement openings may be connected by way of an engagement and/or reach-through space that is provided in the vehicle door under the web. The engagement and/or reach-through space makes it possible for the fingers of a hand to engage or reach through. Thus, the web can be seized in a manner similar to a conventional door handle.

The engagement and/or reach-through space may be u-shaped, as viewed in cross section through the web. Thus, it is possible to engage or reach through with the fingers of a hand. The size and shape of the engagement or reach-through space corresponds substantially to the bent fingers of a hand with a sufficient amount of play.

The engagement and/or reach-through space in the vehicle door may be delimited by a shell. The shell may be rounded so that it is possible to engage and/or reach through with the hand in an unobstructed manner.

The shell may be formed of a plastics material. A one-piece shell can be produced in a cost-effective manner by injection-molding.

The button for actuating the locking device of the vehicle door may be attached to the web on the inside. Thus, the button for actuating the locking device of the vehicle door cannot be seen or barely is seen from the outside. In addition, the button is protected against soiling and/or against the ingress of rainwater. The button may be attached to the web on the inside in a way to be contacted easily or automatically by the fingers of a hand in a rapid and simple manner when the fingers engage the reach-through space.

The web may be reinforced on the inside. For this purpose, a reinforcing structure may be attached to the web on the inside. The reinforcing structure may be formed of a plastics material. The reinforcing structure may be combined with the button for actuating the locking device of the vehicle door. The reinforcing structure may have a rounded shape that can be gripped easily with the fingers of the hand.

The invention also relates to a vehicle outer skin, in particular a web, a shell, a button and/or a reinforcing structure for the above-described vehicle door.

The invention also relates to a motor vehicle with the above-described door.

Further advantages, features and details of the invention will emerge from the description below in which various exemplary embodiments are described in detail with reference to the drawing.

DETAILED DESCRIPTION

Figure 1:
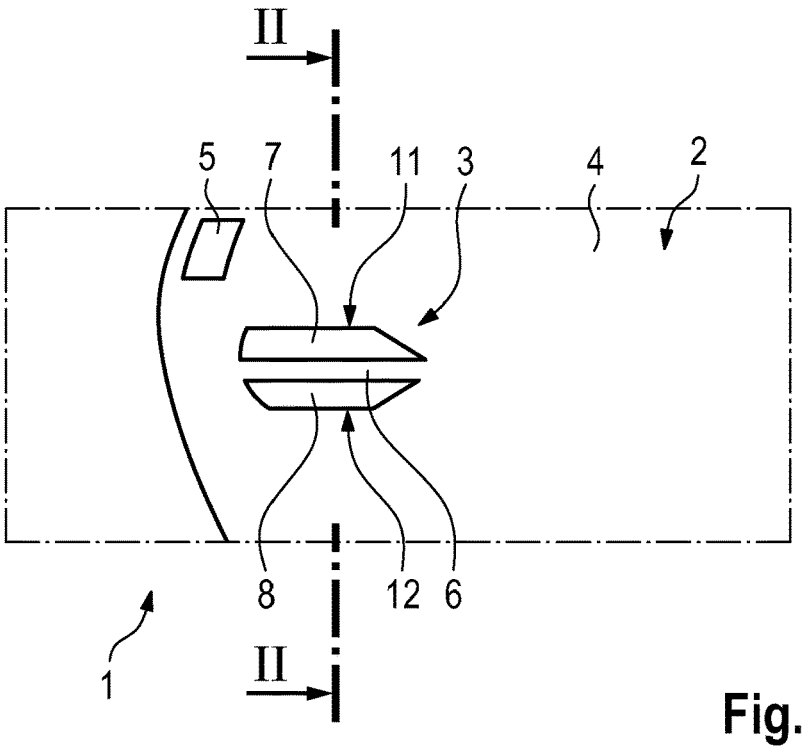
FIG. 1 shows a detail of a motor vehicle with a vehicle door having a door handle which comprises a web which is formed by way of a door outer skin, in a plan view.

FIG. 1 illustrates a part of a motor vehicle 1 with a vehicle door 2. The vehicle door 2 is equipped with a fixed door handle 3 that is flush with the surface of a door outer skin 4. The door outer skin 4 is formed of a sheet-metal material and can also be referred to as a door outer panel.

A locking device 5 of the vehicle door 2 is indicated schematically as a four-sided figure above the door handle 3. The locking device 5 may be the same as or similar to locking devices used in conventional vehicle doors of motor vehicles.

The door handle 3 comprises a substantially horizontal web 6. The horizontal direction corresponds to a vehicle longitudinal direction and also is referred to as x direction.

The web 6 has two apertures 7, 8 in the door outer skin 4. The apertures 7, 8 can be realized in a simple manner from a manufacturing point of view, for example by being punched out of the sheet-metal material that constitutes the door outer skin 4. The apertures 7, 8 define engagement openings 11, 12 in the door outer skin.

Figure 2:
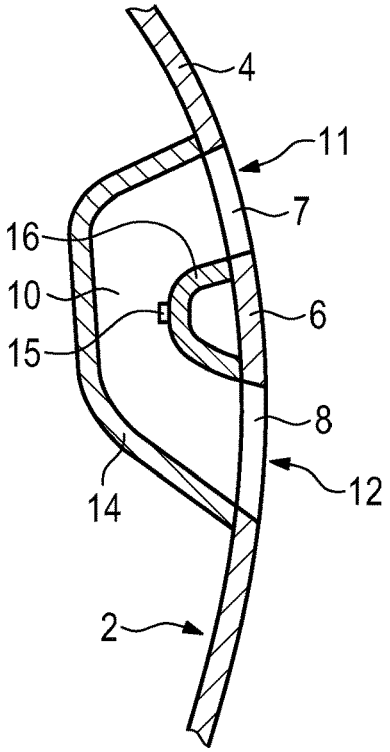
FIG. 2 shows the view of a section along the line II-II in FIG. 1.

FIG. 2 is a section taken along the line II-II in FIG. 1. In the sectional view, it is apparent that the engagement openings 11, 12 make it possible to engage into an engagement and/or reach-through space 10 in the vehicle door 2, above and below the web 6.

The engagement and/or reach-through space 10 is delimited in the vehicle door 2 by a shell 14. A button 15 for actuating the locking device (5 in FIG. 1) is In the engagement and/or reach-through space 10 and is attached to the web 6. The button 15 is not attached directly to the web 6, but rather is attached to a reinforcing structure 16, which in turn is attached to the web 6 on the inside.

As can be seen in FIG. 2, the reinforcing structure 16 is arranged in the shell 14 so that a substantially u-shaped engagement and/or reach-through space 10 is produced, into which it is possible to engage with the fingers of a hand. The web 6 with the reinforcing structure 16 is advantageously embodied in a manner similar to a door handle of conventional motor vehicles.

REFERENCE DESIGNATIONS

1 Motor vehicle
2 Vehicle door
3 Door handle
4 Door outer skin
5 Locking device
6 Web
7 Aperture
8 Aperture
10 Engagement and/or reach-through space
11 Engagement opening
12 Engagement opening
14 Shell
15 Button
16 Reinforcing structure

What is claimed is:

1. A vehicle door comprising: a door outer skin comprising an outer surface and an inner surface, the door outer skin including a web that is flush with areas of the outer surface of the door outer skin adjacent the web, the web delimiting two engagement openings formed in the door outer skin at opposite sides of the web, the engagement openings being connected by a reach-through space provided in the vehicle door inward of the door outer skin, the reach-through space being delimited by a shell that is mounted to the inner surface of the door outer skin adjacent the engagement openings and that defines a concave surface facing toward the door outer skin, a reinforcing structure fixed to the inner surface of the door outer skin defined by the web facing toward the shell, the web and the reinforcing structure defining a fixed door handle, and a button for actuating a locking device of the vehicle door accessible on a surface of the reinforcing structure facing toward the shell.

2. The vehicle door of claim 1, wherein the engagement openings are punched out of the door outer skin.

3. The vehicle door of claim 1, wherein the reach-through space is U-shaped as viewed in cross section through the web.

4. The vehicle door of claim 1, wherein the shell is formed of a plastics material.

5. A vehicle outer skin for the vehicle door of claim 1.

* * * * *